US010897674B2

(12) United States Patent
Ishii et al.

(10) Patent No.: US 10,897,674 B2
(45) Date of Patent: Jan. 19, 2021

(54) ELECTROACOUSTIC TRANSDUCER

(71) Applicant: TAIYO YUDEN CO., LTD., Tokyo (JP)

(72) Inventors: Shigeo Ishii, Takasaki (JP); Hiroshi Hamada, Takasaki (JP); Yutaka Doshida, Takasaki (JP); Takashi Tomita, Takasaki (JP)

(73) Assignee: TAIYO YUDEN CO., LTD., Tokyo (JP)

( * ) Notice: Subject to any disclaimer, the term of this patent is extended or adjusted under 35 U.S.C. 154(b) by 0 days.

(21) Appl. No.: 15/902,889

(22) Filed: Feb. 22, 2018

(65) Prior Publication Data

US 2018/0249255 A1 Aug. 30, 2018

(30) Foreign Application Priority Data

Feb. 27, 2017 (JP) ..... 2017-034514
Mar. 30, 2017 (JP) ..... 2017-066713

(51) Int. Cl.
*H04R 17/00* (2006.01)
*H04R 7/04* (2006.01)
(Continued)

(52) U.S. Cl.
CPC ..... *H04R 17/00* (2013.01); *H04R 1/24* (2013.01); *H04R 7/04* (2013.01); *H04R 9/06* (2013.01);
(Continued)

(58) Field of Classification Search
CPC ..... H04R 1/26; H04R 1/1016; H04R 17/00; H04R 17/005; H04R 23/02
See application file for complete search history.

(56) References Cited

U.S. PATENT DOCUMENTS 4,418,248 A * 11/1983 Mathis ..... H04R 1/26 381/190
5,430,803 A * 7/1995 Kimura ..... H04R 1/1016 381/190
(Continued)

FOREIGN PATENT DOCUMENTS

JP S6268400 U 4/1987
JP 2013150305 A 8/2013
(Continued)

OTHER PUBLICATIONS

A Notification of Reason for Refusal issued by Korean Intellectual Property Office, dated Oct. 18, 2018, for Korean counterpart application No. 1020180021740.
(Continued)

*Primary Examiner* — Fan S Tsang
*Assistant Examiner* — Ryan Robinson
(74) *Attorney, Agent, or Firm* — Law Office of Katsuhiro Arai

(57) ABSTRACT

An electroacoustic transducer includes a piezoelectric speaker and a housing. The piezoelectric speaker has: a first vibration plate with a periphery; a piezoelectric element placed on at least one face of the first vibration plate; and multiple openings that are provided around the piezoelectric element and penetrate through the first vibration plate in its thickness direction that is a first axis direction. The housing has: a supporting part that directly or indirectly supports the periphery; and a sound introduction port that faces the piezoelectric speaker in the first axis direction. The sound introduction port is provided at a position where it does not overlap, in the first axis direction, a first opening having the largest open area among the multiple openings. The electroacoustic transducer can improve the acoustic characteristics of a piezoelectric speaker.

13 Claims, 12 Drawing Sheets

(51) Int. Cl.

| | |
|---|---|
| ***H04R 9/06*** | (2006.01) |
| ***H04R 23/02*** | (2006.01) |
| ***H04R 1/24*** | (2006.01) |
| *H04R 7/18* | (2006.01) |
| *H04R 1/10* | (2006.01) |
| *H04R 5/033* | (2006.01) |
| *H04R 7/14* | (2006.01) |

(52) U.S. Cl.
CPC ..... *H04R 23/02* (2013.01); *H04R 1/1016* (2013.01); *H04R 5/033* (2013.01); *H04R 7/14* (2013.01); *H04R 7/18* (2013.01)

(56) References Cited

U.S. PATENT DOCUMENTS 9,467,761 B2 * 10/2016 Grinker ..... H04R 1/1058
9,467,784 B2 * 10/2016 Huang ..... H04R 1/02
9,503,805 B2 * 11/2016 Huang ..... H04R 1/10
9,628,899 B2 * 4/2017 Huang ..... H04R 17/00
9,721,555 B2 * 8/2017 Takenaka ..... C08K 5/098
2016/0119719 A1 * 4/2016 Doshida ..... H04R 17/00 381/190
2016/0157021 A1 * 6/2016 Ishii ..... H04R 17/00 381/190
2016/0277823 A1 * 9/2016 Huang ..... H04R 1/1016
2016/0286302 A1 * 9/2016 Huang ..... H04R 1/1008
2017/0325014 A1 * 11/2017 Wen ..... H04R 1/1016
2018/0098147 A1 * 4/2018 Hosaka ..... H04R 1/24
2018/0324519 A1 * 11/2018 Park ..... H04R 1/24
2018/0332406 A1 * 11/2018 Park ..... H04R 7/02

FOREIGN PATENT DOCUMENTS

KR 101576134 B1 12/2015
KR 1020160048637 A 5/2016

OTHER PUBLICATIONS

A Notification of Reason for Refusal issued by Korean Intellectual Property Office, dated Apr. 22, 2019, for Korean counterpart application No. 1020180021740. (3 pages).

* cited by examiner

ELECTROACOUSTIC TRANSDUCER

BACKGROUND

Field of the Invention

The present invention relates to an electroacoustic transducer that can be applied to earphones, headphones, mobile information terminals, etc., for example.

Description of the Related Art

Piezoelectric sound-generating elements are widely used as simple electroacoustic conversion means and often found in earphones, headphones, and other acoustic devices, as well as speakers for mobile information terminals, for example. A piezoelectric sound-generating element is typically constituted by a piezoelectric element or elements attached to one side or both sides of a vibration plate (refer to Patent Literature 1, for example).

On the other hand, Patent Literature 2 describes headphones equipped with a dynamic driver and a piezoelectric driver, where these two drivers are driven in parallel to allow sound playback over a wide bandwidth. The piezoelectric driver is provided at the center of the interior face of the front cover that blocks the front face of the dynamic driver and functions as a vibration plate, and the headphones are constituted in such a way that this piezoelectric driver functions as a driver for high-pitch range.

BACKGROUND ART LITERATURES

[Patent Literature 1] Japanese Patent Laid-open No. 2013-150305

[Patent Literature 2] Japanese Utility Model Laid-open No. Sho 62-68400

SUMMARY

Acoustic devices, such as earphones and headphones, are facing a demand for further improvement of sound quality in recent years. Improving the characteristics of piezoelectric sound-generating elements with respect to their electroacoustic conversion function is considered a crucial key to meeting this demand. It is also desired that when these acoustic devices are used with dynamic speakers, the sound pressure in a high-pitch range is higher.

In light of the aforementioned situation, an object of the present invention is to provide an electroacoustic transducer that can improve the acoustic characteristics of a piezoelectric speaker.

Any discussion of problems and solutions involved in the related art has been included in this disclosure solely for the purposes of providing a context for the present invention, and should not be taken as an admission that any or all of the discussion were known at the time the invention was made.

To achieve the aforementioned object, an electroacoustic transducer pertaining to an embodiment of the present invention comprises a piezoelectric speaker and a housing.

The piezoelectric speaker has a first vibration plate with a periphery, a piezoelectric element placed on at least one face of the first vibration plate, and multiple openings that are provided around the piezoelectric element and penetrate through the first vibration plate as viewed in a thickness direction of the first vibration plate that is a first axis direction.

The housing has a supporting part that directly or indirectly supports the periphery and a sound introduction port that faces the piezoelectric speaker in the first axis direction. The sound introduction port is provided at a position where it does not substantially overlap, as viewed in the first axis direction, a first opening having the largest open area (e.g., at least 1.2 times or at least 1.5 times that of opening(s) other than the first opening) among the multiple openings. Typically, the size of the open area is defined as an effective size of the opening (through which sound waves effectively travel) as viewed in the first axis direction, not as an actual size of the opening physically formed in the first vibration plate (e.g., the effective size may be smaller than the actual size when the opening is partially closed or blocked by the piezoelectric element mounted thereon), depending on the configuration of the piezoelectric speaker (in some embodiments, the actual size is used as the size of the open area). In some embodiments, the phrase "does not substantially overlap" refers to no overlapping, less than 5% overlapping, less than 10% overlapping, or the like, with reference to the referenced opening.

According to the electroacoustic transducer, the sound pressure characteristics of the piezoelectric speaker can be improved because the sound introduction port is provided at a position where it does not overlap a first opening in the first axis direction.

The first opening may be partially covered by the periphery of the piezoelectric element.

In this case, the first opening may be constituted by a pair of openings that are facing each other in a second axis direction that is perpendicular to the first axis direction.

Also, the multiple openings may include a second opening that overlaps the sound introduction port in the first axis direction.

Otherwise, the multiple openings may include a second opening that faces the first opening in the second axis direction perpendicular to the first axis direction.

The electroacoustic transducer may further have a support member which has a support face that supports the periphery, is fixed to the supporting part, and is constituted by a material whose Young's modulus is 3 GPa or more. This way, the first vibration plate can be supported in a stable manner when it vibrates, and the sound pressure characteristics in a high-pitch range can be improved.

The constituent material of the support member is not limited in any way, and a metal material, a synthetic resin material, or a composite material primarily constituted by synthetic resin material, may be adopted, for example.

The electroacoustic transducer may further have a first adhesive layer. The first adhesive layer is placed between the support face and the periphery, to elastically support the periphery against the support face.

This way, resonance fluctuation of the first vibration plate is suppressed, and stable resonance operation of the first vibration plate is ensured.

The housing may further have a first housing part that supports the support member, and a second housing part that covers the piezoelectric speaker and is joined to the first housing part, while the support member may further have a first ring-shaped piece that surrounds the periphery. In this case, the electroacoustic transducer further has a second adhesive layer placed between the periphery and the second housing part, and the second adhesive layer elastically supports the first ring-shaped piece against the second housing part.

This way, the support member can be elastically sandwiched between the first housing part and the second housing part, and therefore the piezoelectric speaker can be supported by the support member in a stable manner.

The electroacoustic transducer may further have an dynamic speaker that includes a second vibration plate. In this case, the housing has a first space in which the dynamic speaker is placed, as well as a second space that interconnects the first space and the sound introduction port through the multiple openings.

An electroacoustic transducer pertaining to a different embodiment of the present invention comprises a piezoelectric speaker and a housing.

The piezoelectric speaker has a first vibration plate with a periphery, a piezoelectric element placed on at least one face of the first vibration plate, and an opening that penetrates through the first vibration plate and the piezoelectric element in their thickness direction that is a first axis direction.

The housing has a supporting part that supports the periphery and a sound introduction port facing the piezoelectric speaker in the first axis direction, and provided at a position where it does not overlap the opening in the first axis direction.

According to the present invention, the acoustic characteristics of a piezoelectric speaker can be improved, as described above.

For purposes of summarizing aspects of the invention and the advantages achieved over the related art, certain objects and advantages of the invention are described in this disclosure. Of course, it is to be understood that not necessarily all such objects or advantages may be achieved in accordance with any particular embodiment of the invention. Thus, for example, those skilled in the art will recognize that the invention may be embodied or carried out in a manner that achieves or optimizes one advantage or group of advantages as taught herein without necessarily achieving other objects or advantages as may be taught or suggested herein.

Further aspects, features and advantages of this invention will become apparent from the detailed description which follows.

BRIEF DESCRIPTION OF THE DRAWINGS

These and other features of this invention will now be described with reference to the drawings of preferred embodiments which are intended to illustrate and not to limit the invention. The drawings are greatly simplified for illustrative purposes and are not necessarily to scale.

DESCRIPTION OF THE SYMBOLS

Figure 1:
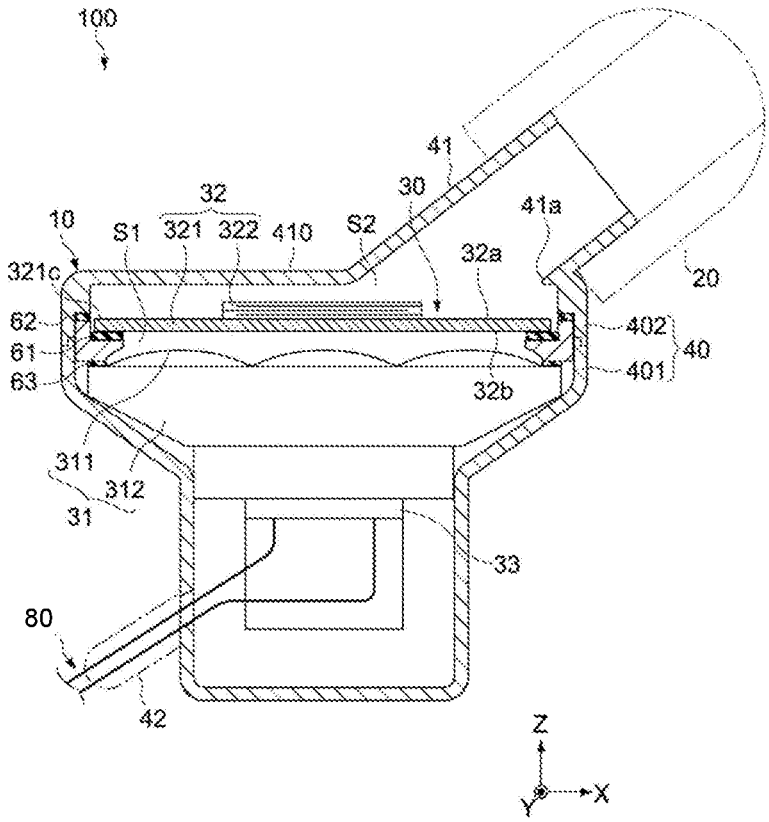
FIG. 1 is a schematic cross-sectional side view showing the constitution of the electroacoustic transducer pertaining to the first embodiment of the present invention.

31—Dynamic speaker
32, 72, 82—Piezoelectric speaker
40—Housing
41*a*—Sound introduction port
100, 200—Earphone
321, 721—Vibration plate
322—Piezoelectric element
331, 731—First openings
332, 732—Second openings
831—Opening
401—First housing
402—Second housing

DETAILED DESCRIPTION OF EMBODIMENTS

Embodiments of the present invention are explained below by referring to the drawings.

First Embodiment

FIG. 1 is a schematic cross-sectional side view showing the constitution of an earphone 100 as an electroacoustic transducer pertaining to an embodiment of the present invention.

In the figure, an X-axis, a Y-axis, and a Z-axis represent three axis directions that are perpendicular to one another.

[Overall Constitution of Earphone]

The earphone 100 has an earphone body 10 and an earpiece 20. The earpiece 20 is attached to a sound guiding path 41 that runs through the earphone body 10, and is constituted in such a way that it can be worn on the user's ear.

The earphone body 10 has a sounding unit 30, and a housing 40 that houses (or encloses) the sounding unit 30. The sounding unit 30 has a dynamic speaker 31 and a piezoelectric speaker 32.

[Housing]

The housing 40 has an interior space in which the sounding unit 30 is housed (or enclosed), and constitutes a two-part split structure that can be separated in the Z-axis direction.

The housing 40 is constituted by a union of a first housing part 401 and a second housing part 402. The first housing part 401 has a housing space in which the sounding unit 30 is housed (or enclosed). The second housing part 402 has a sound guiding path 41 that guides to the exterior the sound waves generated by the sounding unit 30. When it is combined with the first housing part 401 in the Z-axis direction, the second housing part 402 covers the sounding unit 30 together with the first housing part 401.

The sound guiding path 41 has a sound introduction port 41*a* at its basal end (opposite end from the tip where the earpiece 20 is installed). The sound introduction port 41*a* corresponds to an entrance to the sound guiding path 41, and has a circular-shaped opening that parallels an XY plane. The sound introduction port 41*a* is provided at a position offset from the center of the housing 40 in the X-axis direction, and faces the piezoelectric speaker 32 in the Z-axis direction. From the sound introduction port 41*a*, the sound guiding path 41 inclines in the X-axis direction by a specified angle relative to the Z-axis direction, and projects straight in the outward direction from the bottom 410 of the second housing part 402.

The interior space of the housing 40 is divided into a first space S1 and a second space S2 by the piezoelectric speaker 32. The dynamic speaker 31 is placed in the first space S1. The second space S2 interconnects with the sound guiding path 41, and is formed between the piezoelectric speaker 32 and the bottom 410 of the second housing part 402. The first space S1 and the second space S2 interconnect via passages 330 (refer to FIG. 3) in the piezoelectric speaker 32.

[Dynamic Speaker]

The dynamic speaker 31 is constituted by a dynamic speaker unit that functions as a woofer to play back sound in a low-pitch range. In this embodiment, for example, it is constituted by a dynamic speaker that primarily generates sound waves of 7 kHz or lower, and has a mechanism part 311 that includes a vibration body such as a voice coil motor (electromagnetic coil), and a pedestal part 312 that supports the mechanism part 311 in a vibratory manner.

Figure 2:
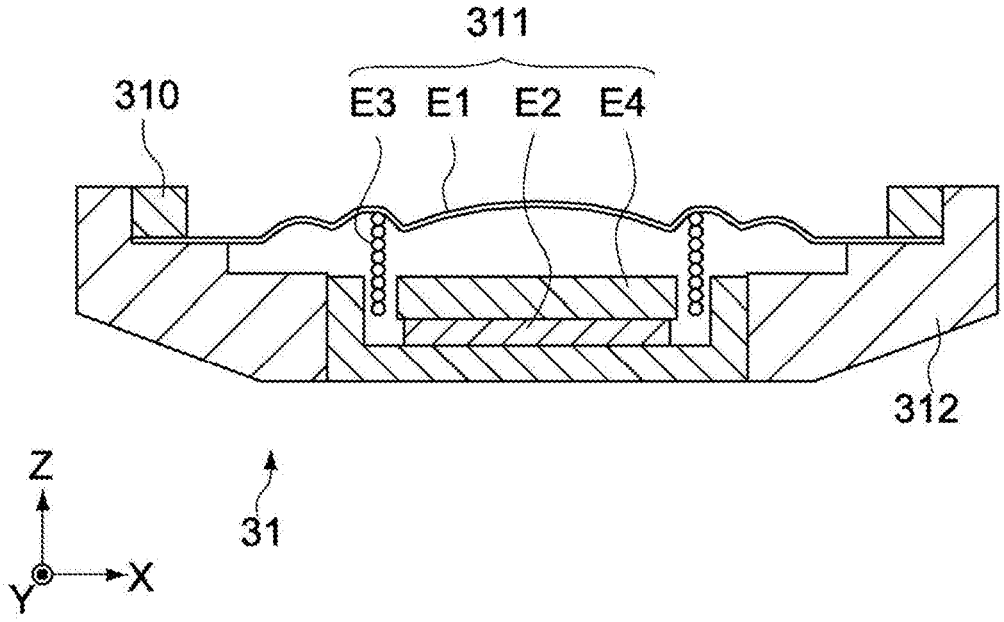
FIG. 2 is a cross-sectional view of key parts, showing a constitutional example of the dynamic speaker in the aforementioned electroacoustic transducer.

The constitution of the mechanism part 311 of the dynamic speaker 31 is not limited in any way. FIG. 2 is a cross-sectional view of key parts, showing a constitutional example of the mechanism part 311. The mechanism part 311 has a vibration plate E1 (second vibration plate) supported on the pedestal part 312 in a vibratory manner, a permanent magnet E2, a voice coil E3, and a yoke E4 that supports the permanent magnet E2. The vibration plate E1 is supported on the pedestal part 312 as its periphery is sandwiched between the bottom of the pedestal part 312 and a ring-shaped retainer 310 integrally assembled therewith.

The voice coil E3 is formed by a conductive wire wound around a bobbin that serves as a winding core, and joined to the center of the vibration plate E1. Also, the voice coil E3 is placed orthogonal to the direction of the magnetic flux of the permanent magnet E2. When alternating current (audio signal) is applied to the voice coil E3, an electromagnetic force acts upon the voice coil E3, and the voice coil E3 vibrates in the Z-axis direction in the figure according to the signal waveform. This vibration is then transmitted to the vibration plate E1 connected to the voice coil E3, and the air inside the first space S1 (FIG. 1) vibrates, to generate sound waves in the low-pitch range as mentioned above.

The dynamic speaker 31 is fixed inside the housing 40 using an appropriate method. Fixed to the top of the dynamic speaker 31 is a circuit board 33 that constitutes the electrical circuit of the sounding unit 30. The circuit board 33 is electrically connected to a cable 80 which is guided into the housing 40 through its lead part 42, and outputs electrical signals to the dynamic speaker 31, and also to the piezoelectric speaker 32, using wiring members that are not illustrated.

[Piezoelectric Speaker]

The piezoelectric speaker 32 constitutes a speaker unit that functions as a tweeter to play back high-pitch range. In this embodiment, for example, its oscillation frequency is set to generate primarily sound waves of 7 kHz or higher. The piezoelectric speaker 32 has a vibration plate 321 (a first vibration plate) and a piezoelectric element 322.

The vibration plate 321 is constituted by a metal (such as 42 alloy) or other conductive material, or resin (such as liquid crystal polymer) or other insulating material, and its planar shape is formed roughly circular. "Roughly circular" means not only circular but also substantially circular as described later. The outer diameter and thickness of the vibration plate 321 are not limited in any way, and set as deemed appropriate according to the size of the housing 40, frequency band of playback sound waves, and so on. In this embodiment, a vibration plate of approx. 8 to 12 mm in diameter and approx. 0.2 mm in thickness is used.

The vibration plate 321 may have cutouts along the outer periphery that are shaped as dimples concaving toward the inner periphery side from the outer periphery, or as slits, as deemed necessary. It should be noted that the planar shape of the vibration plate 321 is considered substantially circular, even when it is not strictly circular because the aforementioned cutouts are formed, etc., so long as an approximate shape is circular.

The vibration plate 321 has a first principal face 32*a* that faces the sound guiding path 41, and a second principal face 32*b* that faces the dynamic speaker 31. In this embodiment, the piezoelectric speaker 32 has a unimorph structure whereby the piezoelectric element 322 is joined only to the first principal face 32*a* of the vibration plate 321.

It should be noted that, in addition to the above, the piezoelectric element 322 may be joined to the second principal face 32*b* of the vibration plate 321. Also, the piezoelectric speaker 32 may be constituted as a bimorph structure whereby each of the principal faces 32*a* and 32*b* of the vibration plate 321 has a piezoelectric element joined thereto.

Figure 3:
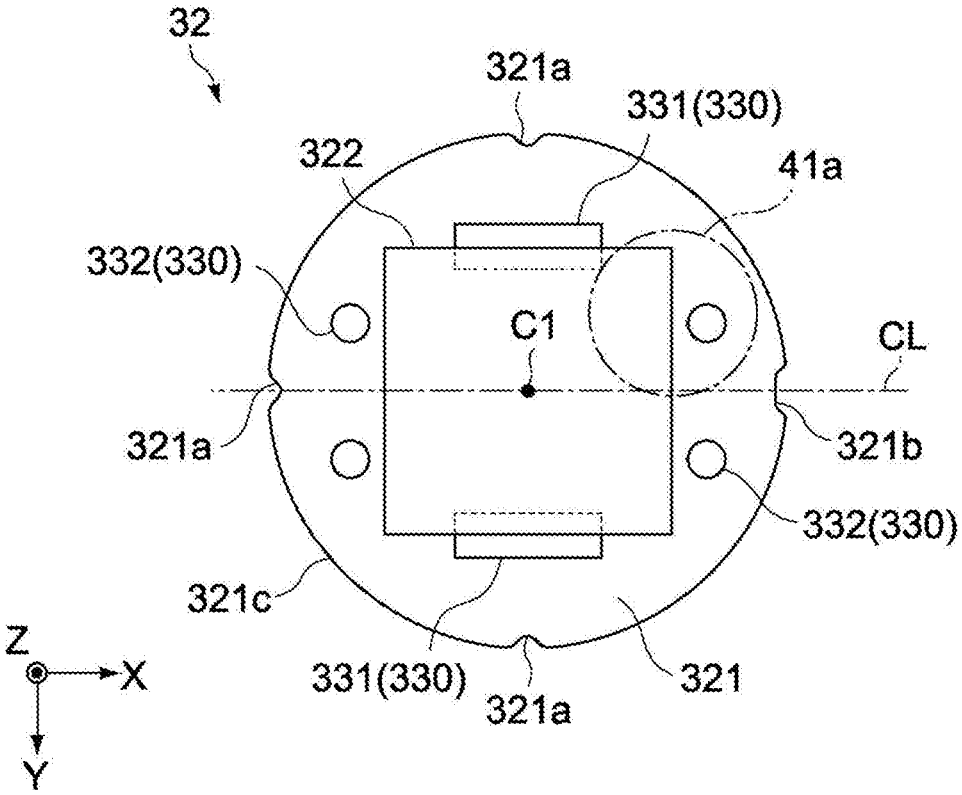
FIG. 3 is a schematic plan view of the piezoelectric speaker in the aforementioned electroacoustic transducer.

FIG. 3 is a plan view of the piezoelectric speaker 32.

As shown in FIG. 3, the planar shape of the piezoelectric element 322 is rectangular, and the center axis of the piezoelectric element 322 is typically coaxial with the center axis C1 of the vibration plate 321. In addition to the above, the center axis of the piezoelectric element 322 may be displaced from the center axis C1 of the vibration plate 321, by a specified amount in the X-axis direction, for example. In other words, the piezoelectric element 322 may be placed at a position offset from the vibration plate 321. This way, the vibration center of the vibration plate 321 shifts to a position different from the center axis C1, and consequently the vibration mode of the piezoelectric speaker 32 becomes asymmetrical with respect to the center axis C1 of the vibration plate 321. Accordingly, the sound pressure characteristics in a high-pitch range can be improved further by, for example, moving the vibration center of the vibration plate 321 closer to the sound guiding path 41.

The vibration plate 321 has the multiple passages 330 in-plane. These passages 330 constitute passages penetrating through the vibration plate 321 in its thickness direction (Z-axis direction), and include first openings 331 and second openings 332. The passages 330 interconnect the first space S1 and the second space S2 inside the housing 40.

The first openings 331 are provided between the periphery 321*c* and the piezoelectric element 322, and each formed as a rectangle of which long sides extend in the X-axis direction. The first openings 331 are formed along the periphery of the piezoelectric element 322, and are partially covered by the periphery of the piezoelectric element 322. The first openings 331 provide not only a function as passages that penetrate through the vibration plate 321 from its front to back, but also a function to prevent short-circuiting between two external electrodes of the piezoelectric element 322, as described later.

The first openings 331 have the largest open area among the multiple openings that constitute the passages 330. The number of first openings 331 is not limited in any way, and may be one, two, or more. In this embodiment, openings of the same size, and having a rectangular open shape of which long sides extend in the X-axis direction, are provided directly underneath a pair of opposing sides of the piezoelectric element 322 in the Y-axis direction.

The second openings 332 are constituted by multiple circular holes that are provided in the area between the periphery 321*c* of the vibration plate 321 and the piezoelectric element 322. These (total four) second openings 332 are respectively provided at positions symmetrical with respect to the center axis C1, along the center line CL (line passing through the center of the vibration plate 321 and running parallel with the X-axis direction). The second openings 332 are each formed as a round hole having the same diameter (such as a diameter of approx. 1 mm); however, needless to say, their shape is not limited to the foregoing.

In this embodiment, arced or rectangular concaves 321*a* and 321*b* are provided at 90-degree intervals along the periphery of the vibration plate 321, as shown in FIG. 3. These concaves 321*a* and 321*b* may be used as reference points that are referenced when the vibration plate 321 is joined to the housing 40 or a support member 50, or they may be used as reference points that are referenced when piezoelectric element 322 is positioned onto the vibration plate 321. Especially, as shown in the figure, the one concave 321*b* of the four concaves may be shaped differently from the other three concaves 321*a*, so that a directional guide for the vibration plate 321 is provided, and thereby mis-assembling of the vibration plate 321 with the housing 40 is prevented, which is beneficial.

In this embodiment, the sound introduction port 41*a* is provided at a position where it does not overlap (face) any one of the first openings 331 in the Z-axis direction. In other words, the piezoelectric speaker 32 is installed in the housing 40 in such a way that none of the first openings 331 overlap the sound introduction port 41*a* in the Z-axis direction. This way, the acoustic characteristics of the piezoelectric speaker 32 can be improved, as described later. It should be noted that FIG. 3 shows an example where the sound introduction port 41*a* is provided at a position where it overlaps (faces) one of the second openings 332 in the Z-axis direction.

Figure 4:
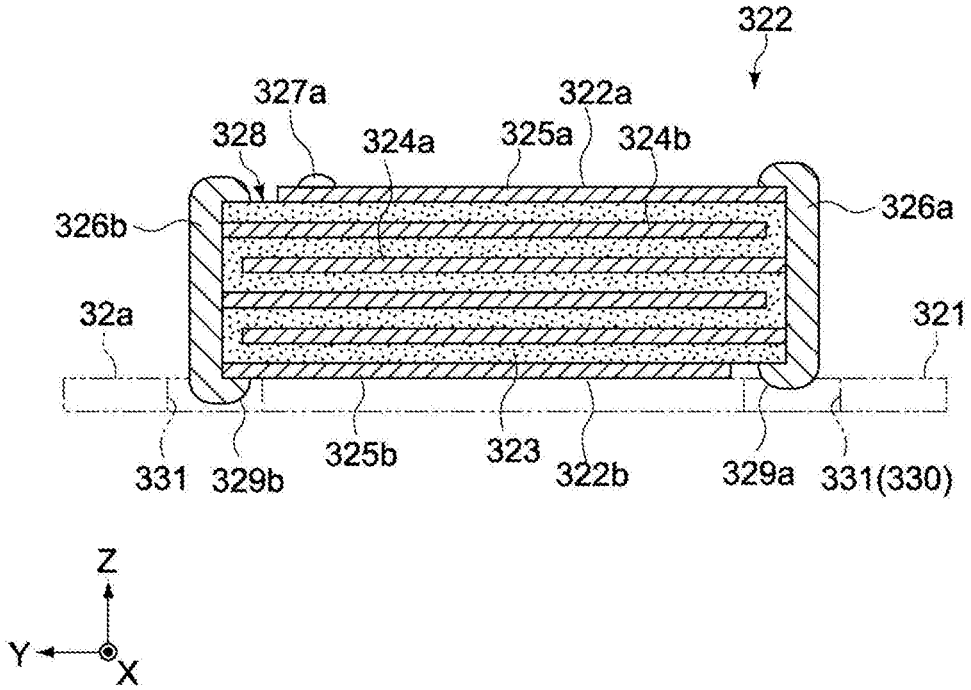
FIG. 4 is a schematic cross-sectional view showing the internal structure of the piezoelectric element in the aforementioned piezoelectric speaker.

FIG. 4 is a schematic cross-sectional view showing the internal structure of the piezoelectric element 322.

The piezoelectric element 322 has an element body 328, as well as a first external electrode 326*a* and a second external electrode 326*b* that are facing each other in the X- and Y-axis directions. Also, the piezoelectric element 322 has a first principal face 322*a* and a second principal face 322*b* that are facing each other and perpendicular to the Z axis. The second principal face 322*b* of the piezoelectric element 322 is constituted as an installation surface facing the first principal face 32*a* of the vibration plate 321.

The element body 328 has a structure where ceramic sheets 323 and internal electrode layers 324*a* and 324*b* are stacked together in the Z-axis direction. To be specific, the internal electrode layers 324*a* and 324*b* are stacked alternately with the ceramic sheets 323 in between. The ceramic sheets 323 are formed by lead zirconate titanate (PZT), niobium oxide containing alkali metal, or other piezoelectric material, for example. The internal electrode layers 324*a* and 324*b* are formed by any of various metal materials or other conductive materials.

The first internal electrode layers 324*a* of the element body 328 are connected to the first external electrode 326*a*, while being insulated from the second external electrode 326*b* by a margin part of the ceramic sheets 323. Also, the second internal electrode layers 324*b* of the element body 328 are connected to the second external electrode 326*b*, while being insulated from the first external electrode 326*b* by a margin part of the ceramic sheets 323.

In FIG. 4, the topmost layer among the first internal electrode layers 324*a* constitutes a first lead electrode layer 325*a* that partially covers the front face (top face in FIG. 4) of the element body 328, while the bottommost layer among the second internal electrode layers 324*b* constitutes a second lead electrode layer 325*b* that partially covers the back face (bottom face in FIG. 4) of the element body 328. The first lead electrode layer 325*a* has a terminal part 327*a* of one polarity which is electrically connected to the circuit board 33 (FIG. 1), while the second lead electrode layer 325*b* is electrically and mechanically connected to the first principal face 32*a* of the vibration plate 321 via an appropriate joining material. If the vibration plate 321 is constituted by a conductive material, then this joining material may be a conductive adhesive, solder, or other conductive joining material, in which case a terminal part of the other polarity may be provided on the vibration plate 321.

The first and second external electrodes 326*a* and 326*b* are formed by any of various metal materials or other conductive materials, at roughly the X-axis direction centers of both end faces of the element body 328. The first external electrode 326*a* is electrically connected to the first internal electrode layers 324*a* and the first lead electrode layer 325*a*, while the second external electrode 326*b* is electrically connected to the second internal electrode layers 324*b* and the second lead electrode layer 325*b*.

This constitution means that, when alternating-current voltage is applied between the external electrodes 326*a* and 326*b*, then each of the ceramic sheets 323 between the respective internal electrode layers 324*a* and 324*b* expands and contracts at a specified frequency. As a result, the piezoelectric element 322 can generate the vibration to be given to the vibration plate 321.

It should be noted that the first and second external electrodes 326*a* and 326*b* project from the respective end faces of the element body 328, as shown in FIG. 4. Then, raised parts 329*a* and 329*b* that project toward the first principal face 32*a* of the vibration plate 321 may be formed on the first and second external electrodes 326*a* and 326*b*. Accordingly, the aforementioned first openings 331 are each formed to a size that can house the raised part 329*a* or 329*b*. This prevents an electrical shorting between the external electrodes 326*a* and 326*b*, which would otherwise occur upon contact between the raised part 329*a* or 329*b* and the vibration plate 321.

Figure 5:
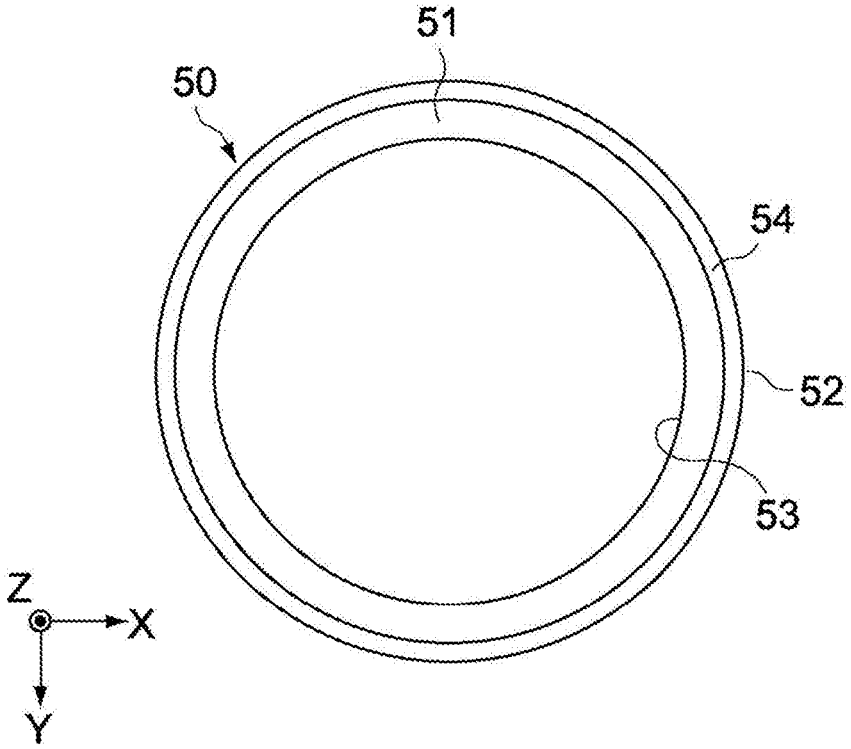
FIG. 5 is a schematic plan view of the support member in the aforementioned electroacoustic transducer.
Figure 6:
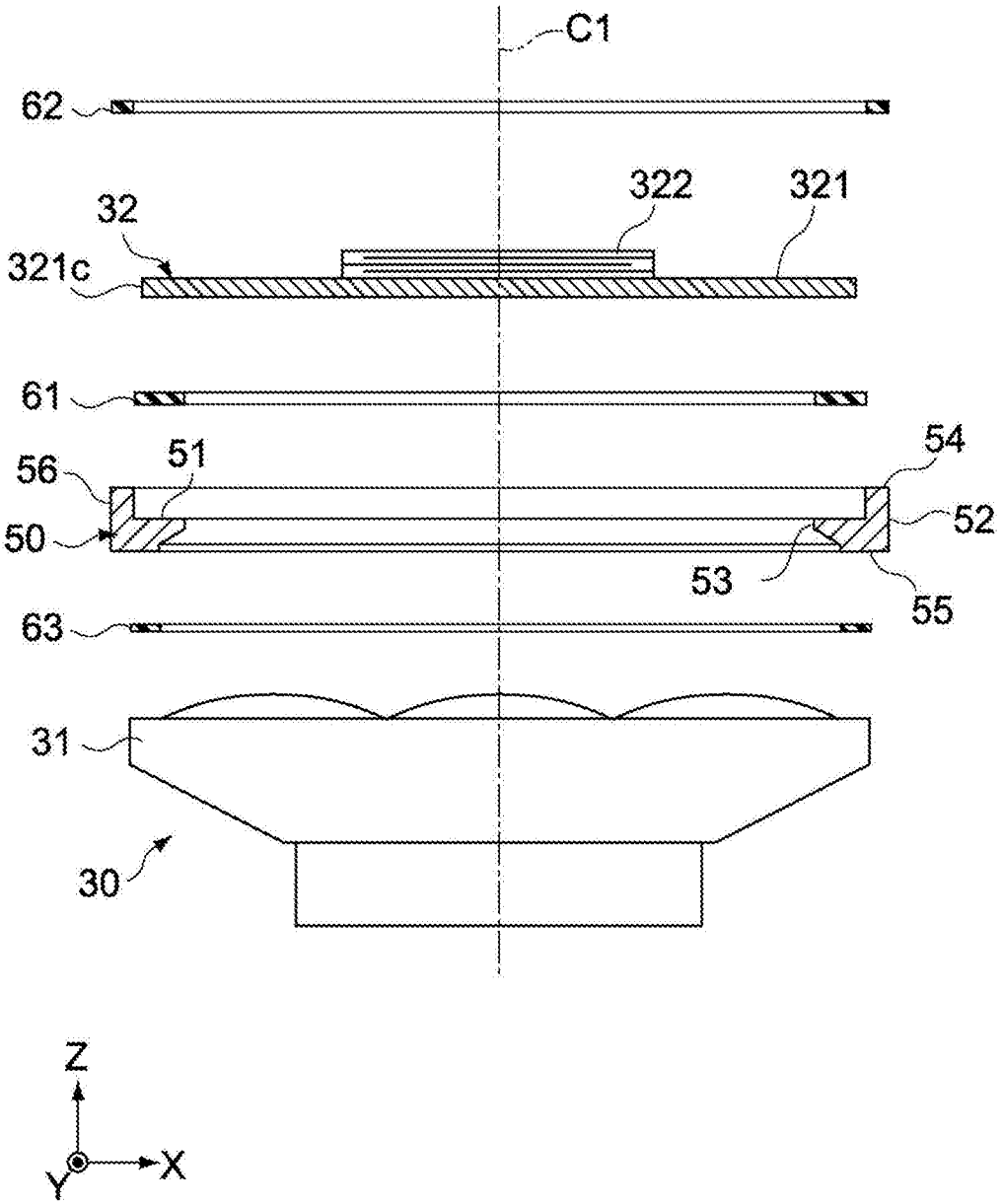
FIG. 6 is an exploded cross-sectional side view of a sounding unit including the aforementioned piezoelectric speaker.

The earphone 100 has the support member 50 (supporting part) that supports the piezoelectric speaker 32 in a vibratory manner inside the housing 40. FIG. 5 is a schematic plan view of the support member 50, while FIG. 6 is an exploded cross-sectional side view of the sounding unit 30 including the support member 50.

The support member 50 is constituted by a ring-shaped (annular) block, as shown in FIG. 5. The support member 50 has a support face 51 that supports the periphery 321*c* of the vibration plate 321 of the piezoelectric speaker 32; an outer periphery face 52 facing the interior wall of the housing 40; an inner periphery face 53 facing the first space S1; a tip face 54 joined to the housing 40 (the second housing part 402); and a bottom face 55 joined to the periphery of the dynamic speaker 31.

The support face 51 is joined to the periphery 321*c* of the vibration plate 321 via an annular adhesive layer 61 (a first adhesive layer). This way, the vibration plate 321 is elastically supported on the support member 50, which suppresses resonance fluctuation of the vibration plate 321 and thereby ensures stable resonance operation of the vibration plate 321.

Also, the tip face 54 is joined to the inner periphery of the second housing part 402 via an annular adhesive layer 62 (a second adhesive layer). The bottom face 55 is joined to the dynamic speaker 31 via an annular adhesive layer 63 (a third adhesive layer). This way, the support member 50 can be elastically sandwiched between the first housing part 401 and the second housing part 402, and therefore the piezoelectric speaker 32 can be supported by the support member 50 in a stable manner.

The adhesive layers 61 to 63 are each constituted by a material having appropriate elasticity, which is typically a double-sided adhesive tape cut to each specified diameter. The adhesive layers 61 to 63 may also be constituted, besides the above, by a hardened viscoelastic resin, viscoelastic film having pressure-bonding property, or the like. In addition, constituting the adhesive layers 61 to 63 using annular bodies increases the airtightness between the dynamic speaker 31 and the support member 50, airtightness between the support member 50 and the vibration plate 321, and airtightness between the support member 50 and the housing 40. Consequently the sound waves generated in the first and second space S1 and S2 can be guided to the sound guiding path 41 in an efficient manner.

The support member 50 is constituted by a material whose Young's modulus (longitudinal elastic modulus) is 3 GPa or more, for example. The support member 50 constituted by such material can ensure a relatively high rigidity, which means that it can stably support the piezoelectric speaker 32 (the vibration plate 321) that vibrates in a relatively high frequency band of 7 kHz or higher.

The upper limit of the Young's modulus of the material constituting the support member 50 is not limited in any way, but since materials that independently demonstrate 5 GPa or more, for example, are virtually limited to metals, ceramics, and other inorganic materials, any upper limit can be set as deemed appropriate, such as 500 GPa or less, according to the balance of weight, production cost, etc. On the other hand, forming the support member 50 with a synthetic resin material provides an advantage in terms of weight reduction and productivity improvement.

The materials whose Young's modulus is 3 GPa or more include, for example, metal materials, ceramics, synthetic resin materials, and composite materials primarily constituted by synthetic resin materials. Any metal material may be adopted without limitation, such as rolled steel, stainless steel, cast iron, or other ferrous materials; or aluminum, brass, or other nonferrous materials. Among the ceramics, SiC, $Al_2O_3$, or other materials can be applied as deemed appropriate.

The synthetic resin materials include polyphenylene sulfide (PPS), polymethyl methacrylate (PMMA), polyacetal (POM), hard vinyl chloride, and methyl methacrylate-styrene copolymer (MS), among others. Also, polycarbonate (PC), styrene-butadiene-acrylonitrile copolymer (ABS) or other resin materials that do not independently offer 3 GPa or more of Young's modulus may be blended with a filler (filling material) constituted by glass fibers or other fibers or by inorganic grains or other fine grains, and the resulting composite material (reinforced plastic) whose Young's modulus (longitudinal elastic modulus) is 3 GPa or more can be adopted.

The support member 50 need not be a simple sheet material but may be formed into a three-dimensional shape of which thickness varies from area to area. This achieves a higher second moment of area, and consequently higher rigidity (bending rigidity), even when the Young's modulus of the material remains the same.

For example, the support member 50 in this embodiment has a ring-shaped piece 56 (a first ring-shaped piece) that projects upward along the outer periphery of the support face 51 and surrounds the periphery 321*c* of the vibration plate 321 (refer to FIG. 6), and the aforementioned tip face 54 is formed on top of this piece. This makes the support member 50 thicker on the outer periphery side than on the inner periphery side, and thus more rigid against torsion or bending.

[Earphone Operation]

Next, a typical operation of the earphone 100 in this embodiment, as constituted above, is explained.

The earphone 100 in this embodiment is configured such that reproduced signals are input to the circuit board 33 of the sounding unit 30 via the cable 80. Reproduced signals are input to the dynamic speaker 31 and the piezoelectric speaker 32 via the circuit board 33. As a result, the dynamic speaker 31 is driven, and primarily sound waves in a low-pitch range of 7 kHz or lower are generated. In the case of the piezoelectric speaker 32, on the other hand, the vibration plate 321 vibrates as the piezoelectric element 322 extends and contracts, and primarily sound waves in a high-pitch range of 7 kHz or higher are generated as a result. The generated sound waves in the respective frequency ranges are transmitted to an ear of a user via the sound guiding path 41. The earphone 100 thus functions as a hybrid speaker having a sounding body in a low-pitch range and a sounding body in a high-pitch range.

In the meantime, each sound wave generated by the dynamic speaker 31 is formed as a composite wave with a sound wave component that vibrates the vibration plate 321 of the piezoelectric speaker 32 and propagates to the second space S2, and a sound wave component that propagates to the second space S2 via the passages 330. Accordingly, by optimizing the opening area or the number of passages 330, sound waves in a low-pitch range output from the piezoelectric speaker 32 can be adjusted or tuned to such frequency characteristics that provide a sound pressure peak in a specified low-pitch range.

According to this embodiment, the sound pressure characteristics of the piezoelectric speaker 32 can be improved because the sound introduction port 41*a* is provided at a position where it does not overlap any one of the first openings 331 of the piezoelectric speaker 32 in the Z-axis direction.

Also, in this embodiment, the support member 50 is constituted by a material whose Young's modulus is 3 GPa or more, which means that the sound pressure levels are markedly higher in a high-pitch range of 9 kHz or higher, and consequently clear sound quality can be realized.

Figure 7:
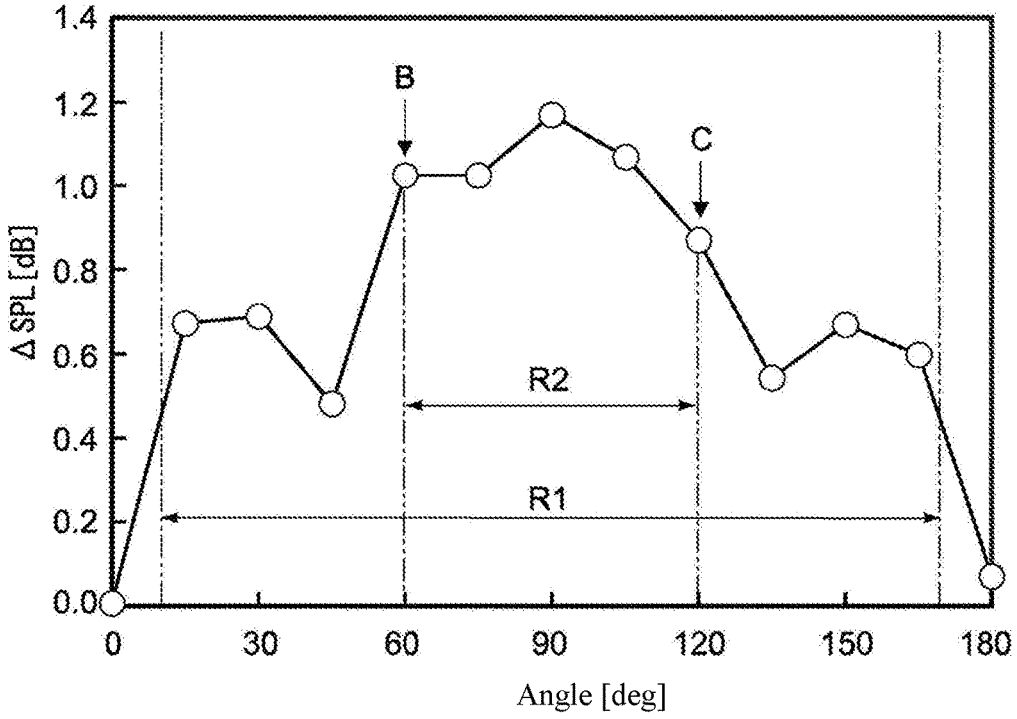
FIG. 7 is a result of an experiment, showing an example of sound pressure characteristics of the aforementioned piezoelectric speaker.
Figure 8A:
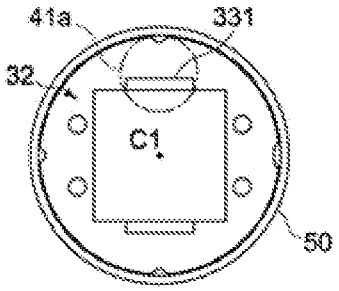
FIGS. 8A through 8D are schematic plan views explaining the relative positions of a piezoelectric speaker and a sound introduction port.
Figure 8B:
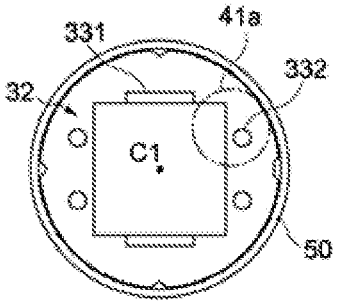
Figure 8C:
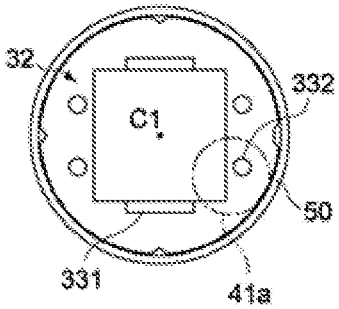
Figure 8D:
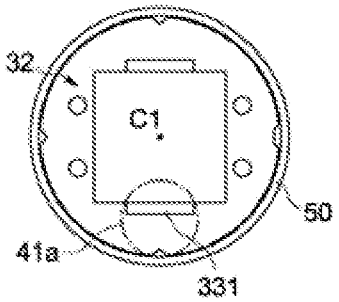

FIGS. 7 and 8A through 8D present the result of an experiment, showing how the sound pressure characteristics change when the sound introduction port 41*a* is positioned differently relative to the piezoelectric speaker 32. In this experiment, the piezoelectric speaker 32 shown in FIG. 3 was produced and rotated at a 15° pitch around the center axis C1 inside the housing 40 to change the position of the piezoelectric speaker 32 relative to the sound introduction port 41*a,* and the average sound pressure level (SPL: Sound Pressure Level) at frequencies from 8 to 20 kHz was measured at each position. In this experiment, the rotated position of the piezoelectric speaker 32 as shown in FIG. 8A was defined as 0°, and the piezoelectric speaker 32 was rotated clockwise by 180° from this position (FIGS. 8B, 8C, and 8D show rotation angles of 60°, 120°, and 180°, respectively). In FIG. 7, the sound pressure level at each rotated position was indicated by a difference from the average sound pressure level at 0°.

The dimension of each part of the piezoelectric speaker 32 is as follows.

Diameter of the vibration plate 321: 12 mm

Size of the piezoelectric element 322: 7 mm lengthwise (dimension in the Y-axis direction), 7 mm widthwise (dimension in the X-axis direction)

Size of the first openings 331: 3.6 mm long (dimension in the X-axis direction), 0.5 mm wide (dimension in the Y-axis direction)

Diameter of the second openings 332: 1 mm

Diameter of the sound introduction port 41*a:* 4.1 mm

As shown in FIG. 7, the average sound pressure levels obtained at all rotated positions other than 0°, were higher than the level at 0°. It should be noted that, since the piezoelectric speaker 32 is symmetrical with respect to the X-axis (refer to FIG. 3), the sound pressure level at 180° is considered virtually the same as that at 0°.

Also, the angle range indicated by R1 in FIG. 7 represents an area where the sound introduction port 41*a* does not maximally overlap one of the first openings 331, and as shown, the sound pressure level varies according to the rotated position in this angle range. In particular, the angle range indicated by R2 (60° to 120°) corresponds to an area where the sound introduction port 41*a* does not overlap one of the first openings 331 in the Z-axis direction, and in this range higher sound pressure levels were obtained compared to the levels in other angle ranges.

According to this embodiment, the sound introduction port 41*a* is placed at a position where it does not face the first openings 331, as described above. Therefore, an electroacoustic transducer (earphone) 100 having the dynamic speaker 31 and the piezoelectric speaker 32, as described in this embodiment, makes it less likely for the sound generated by the dynamic speaker 31 to reach the sound guiding path 41 directly. As a result, sound pressure levels in a high-pitch range attributed to the piezoelectric speaker 32 can be made relatively higher.

Figure 9:
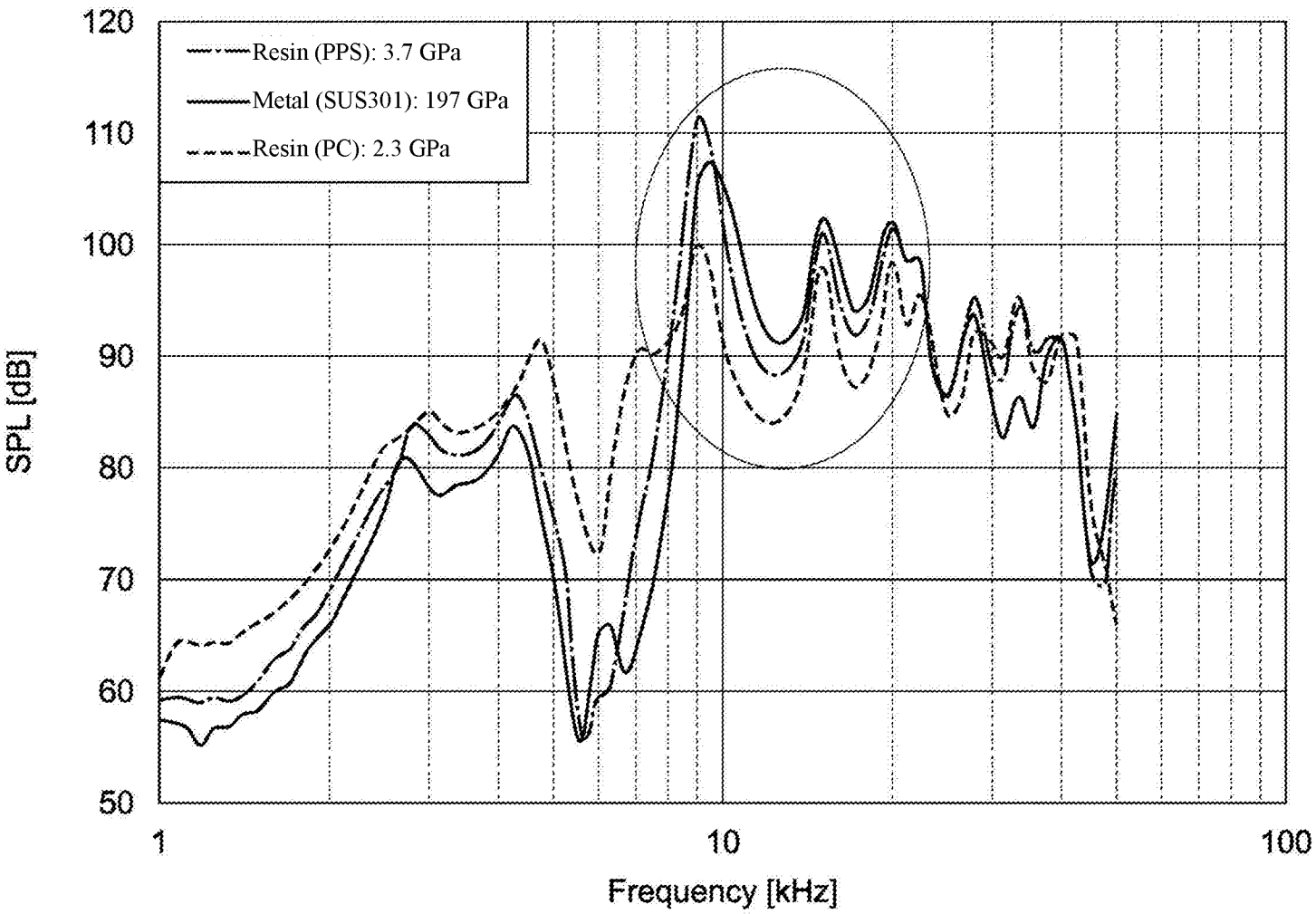
FIG. 9 is a result of an experiment, showing the sound pressure characteristics measured on a piezoelectric speaker produced by changing the material of the aforementioned support member.

FIG. 9 presents the result of an experiment, showing the sound pressure characteristics measured on the piezoelectric speaker 32 produced by changing the material of the support member 50. In the figure, the vertical axis represents the sound pressure level, while the horizontal axis represents the frequency, and for the constituent materials of the support member, SUS with a Young's modulus of 197 GPa (solid line), PPS with a Young's modulus of 3.7 GPa (dashed-dotted line), and PC with a Young's modulus of 2.3 GPa (broken line), were used.

As shown in this figure, the sound pressure levels obtained when the support members made of SUS and PPS were used, were better than the sound pressure levels obtained when the support member made of PC was used, over a range of near 9 kHz to near 20 kHz. This is probably because the piezoelectric speaker vibrating at frequencies of 9 kHz or higher could not be supported in a stable manner with a support member with a Young's modulus of 3 GPa or less, and consequently the vibration of the vibration plate 321 was diminished by the vibration of the support member itself. By contrast, using a highly rigid support member with a Young's modulus of 3 GPa or more would allow the vibration plate 321 vibrating at high frequencies to be supported in a more stable manner, which in turn would make it possible to improve the sound pressure levels in the high frequency range.

Figure 10:
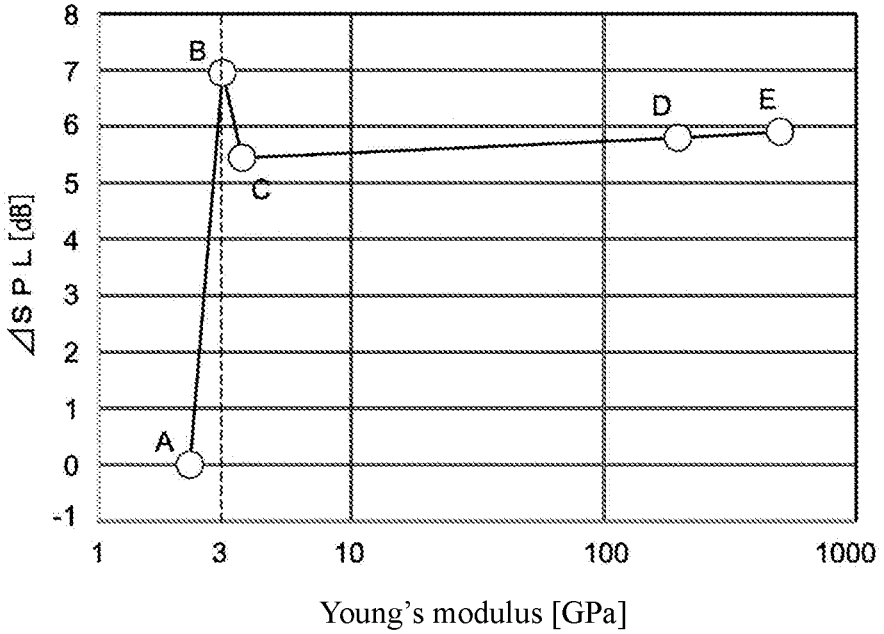
FIG. 10 is a result of an experiment, showing the relation between the Young's modulus of the aforementioned support member and the sound pressure level of the piezoelectric speaker.

FIG. 10 presents the result of an experiment, showing the relation between the Young's modulus of the support member 50 and the average sound pressure level (SPL) of the piezoelectric speaker 32 over a range of 8 kHz to 20 kHz.

In this experiment, five materials, each with a different Young's modulus, were used to constitute support member samples A to E, and the sound pressure levels with samples B to E were expressed by differences from the sound pressure level with sample A. The constituent material (and its Young's modulus) of each sample is as follows.

Sample A: PC (2.3 GPa)

Sample B: Reinforced PC (3.1 GPa)

Sample C: PPS (3.7 GPa)

Sample D: SUS301 (197 GPa)

Sample E: SiC (500 GPa)

It should be noted that samples A, C, and D correspond to the materials indicated by the broken line, dashed-dotted line, and solid line in FIG. 9, respectively.

As shown in FIG. 10, the sound pressure levels with samples B to E whose Young's modulus is 3 GPa or more are better by +5 dB or more than the sound pressure levels with sample A whose young's modulus is less than 3 GPa. As shown above, constituting the support member 50 using a material whose Young's modulus is 3 GPa or more increases the sound pressure in a high frequency range of 8 kHz to 20 kHz in an efficient way, and consequently the acoustic characteristics in a high-pitch range can be improved.

Second Embodiment

Figure 11:
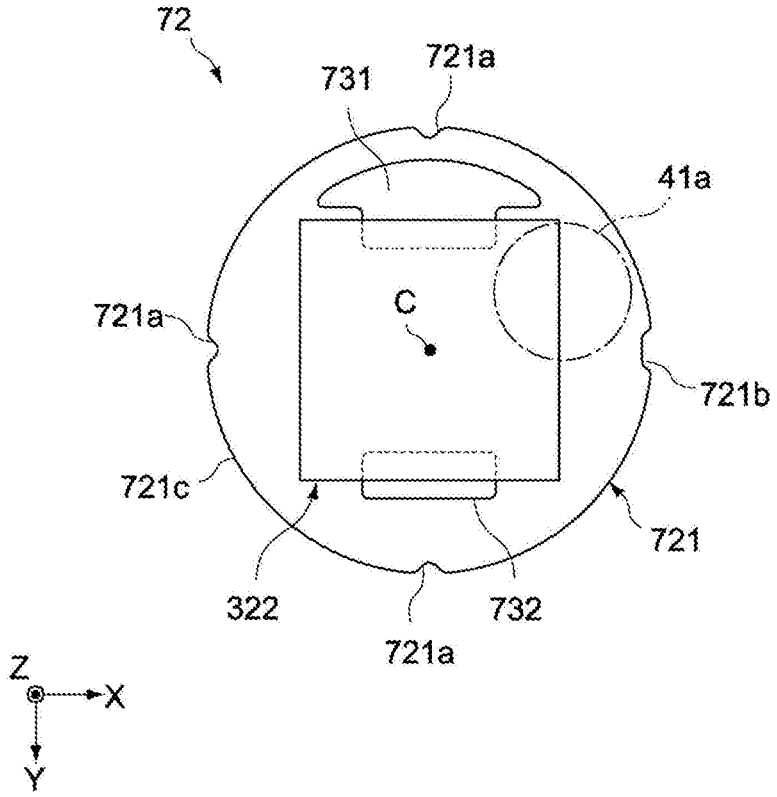
FIG. 11 is a schematic plan view of the piezoelectric speaker in the electroacoustic transducer pertaining to the second embodiment of the present invention.

FIG. 11 is a plan view of a piezoelectric speaker of an electroacoustic transducer pertaining to the second embodiment of the present invention. The following primarily explains those constitutions different from the corresponding constitutions in the first embodiment, and other constitutions identical to those in the first embodiment are denoted by the same symbols and not explained or explained succinctly.

A piezoelectric speaker 72 in this embodiment has two openings, including a first opening 731 and a second opening 732, which serve as passages provided in a circular vibration plate 721 in-plane. The first and second openings 731, 732 also function as openings to prevent short-circuiting. The first opening 731 is formed to have a larger open area than the second opening 732.

The first opening 731 is formed roughly in the shape of a semicircle or crescent in an area between a periphery 721*c* of the vibration plate 721 and one side of the piezoelectric element 322. In this embodiment, the piezoelectric speaker 72 is assembled to the housing 40 in such a way that the first opening 731 does not face the sound introduction port 41*a* in the Z-axis direction. The second opening 732 is formed in the same rectangular shape as the first opening 331 in the first embodiment.

Four concaves 721*a* and 721*b* are provided at 90° intervals along the periphery 721*c* of the vibration plate 721. These concaves 721*a* and 721*b* are used for positioning of the vibration plate 721 relative to the housing 40. Especially, as shown in the figure, one concave 721*b* of the four concaves may be shaped differently from the other three concaves 721*a*, so that a directional guide for the vibration plate 721 is provided, and thereby mis-assembling of the vibration plate 721 with the housing 40 is prevented, which is beneficial.

According to the electroacoustic transducer in this embodiment, as constituted above, the sound pressure characteristics of the piezoelectric speaker 72 can be improved in the same manner as in the first embodiment, because the sound introduction port 41*a* is provided at a position where it does not overlap the first opening 331 of the piezoelectric speaker 32 in the Z-axis direction.

Figure 12:
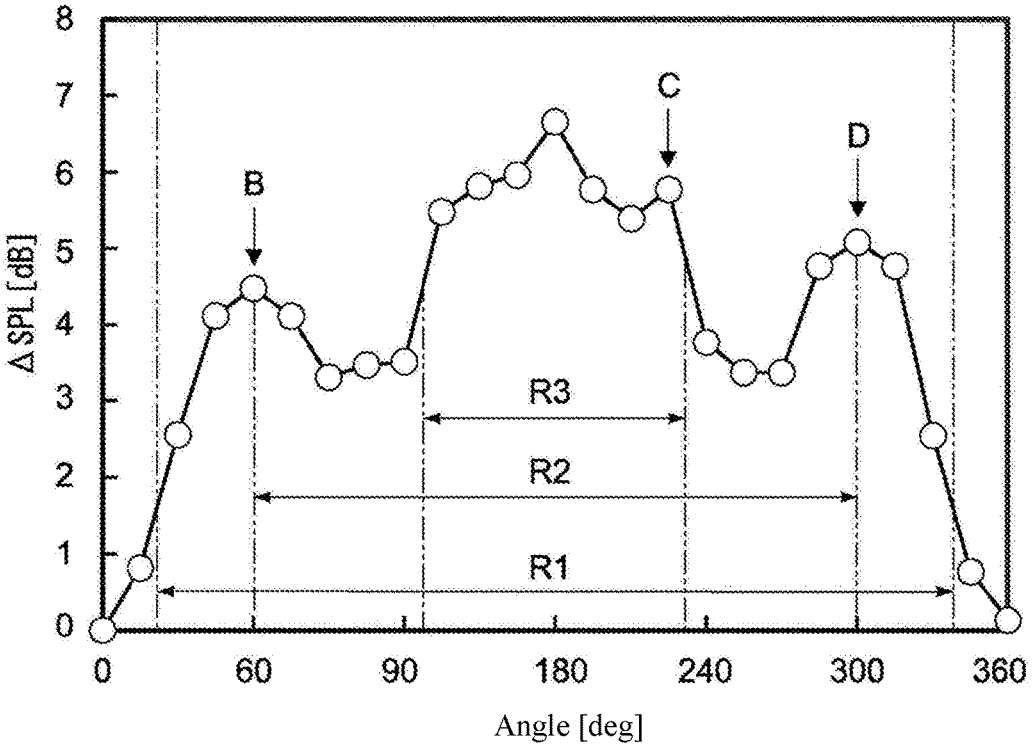
FIG. 12 is an experimental result showing an example of sound pressure characteristics of the aforementioned piezoelectric speaker.
Figure 13A:
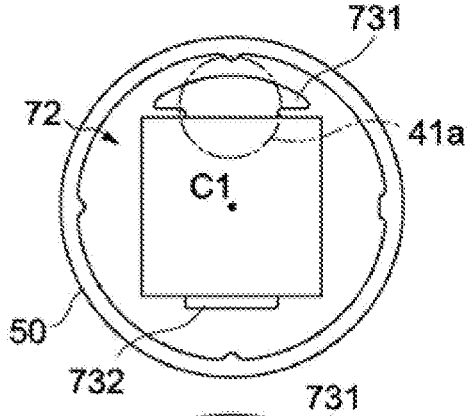
FIGS. 13A through 13D are schematic plan views explaining the relative positions of a piezoelectric speaker and a sound introduction port.
Figure 13B:
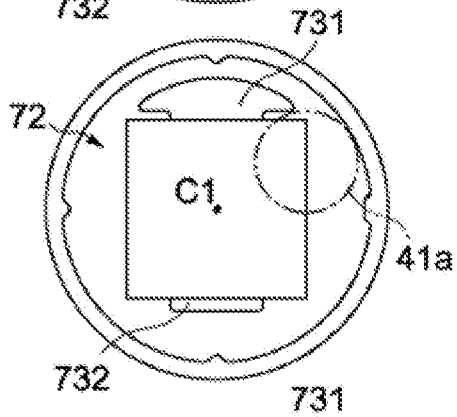
Figure 13C:
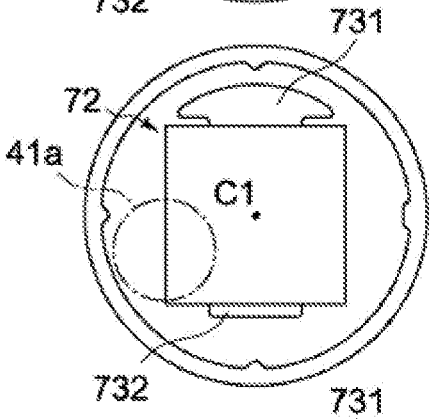
Figure 13D:
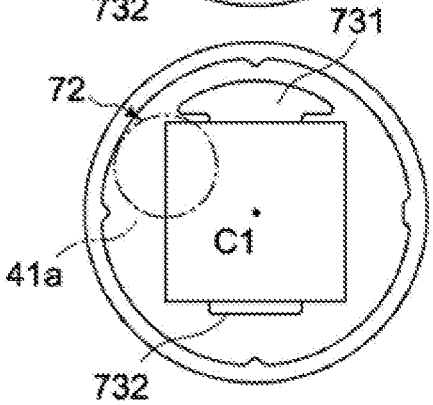

FIGS. 12 and 13A through 13D present the result of an experiment, showing how the sound pressure characteristics change when the sound introduction port 41*a* is positioned differently relative to the piezoelectric speaker 72. In this experiment, the piezoelectric speaker 72 shown in FIGS. 13A through 13D were produced and rotated at a 15° pitch around the center axis C1 inside the housing 40 to change the position of the piezoelectric speaker 72 relative to the sound introduction port 41*a*, and the average sound pressure level (SPL: Sound Pressure Level) at frequencies from 8 to 20 kHz was measured at each position. In this experiment, the rotated position of the piezoelectric speaker 72 as shown in FIG. 13A was defined as 0°, and the piezoelectric speaker 72 was rotated clockwise by 360° (one rotation) from this position (FIGS. 13B, 13C, and 13D show rotation angles of 60°, 240°, and 300°, respectively). In FIG. 12, the sound pressure level at each rotated position was indicated by a difference from the average sound pressure level at 0°.

The dimension of each part of the piezoelectric speaker 72 is as follows.

Diameter of the vibration plate 721: 12 mm

Size of the piezoelectric element 322: 7 mm lengthwise (dimension in the Y-axis direction), 7 mm widthwise (dimension in the X-axis direction)

Size of the first opening 731: 6.1 mm long (dimension in the X-axis direction), 1.6 mm wide (dimension in the Y-axis direction)

Diameter of the second opening 732: 1 mm

Diameter of the sound introduction port 41*a*: 4.1 mm

As shown in FIG. 12, the average sound pressure levels obtained at all rotated positions other than 0° and 360°, were higher than the level at 0°.

Also, the angle range indicated by R1 in FIG. 12 represents an area where the sound introduction port 41*a* does not maximally overlap the first opening 731, and as shown, the sound pressure level varies according to the rotated position in this angle range. In particular, the angle range indicated by R2 (60° to 300°) corresponds to an area where the sound introduction port 41*a* does not overlap the first opening 731 in the Z-axis direction, and relatively high sound pressure levels were obtained. Particularly in the angle range indicated by R3 (approx. 100° to approx. 230°), higher sound pressure levels were obtained compared to the levels in other angle ranges.

Third Embodiment

Figure 14:
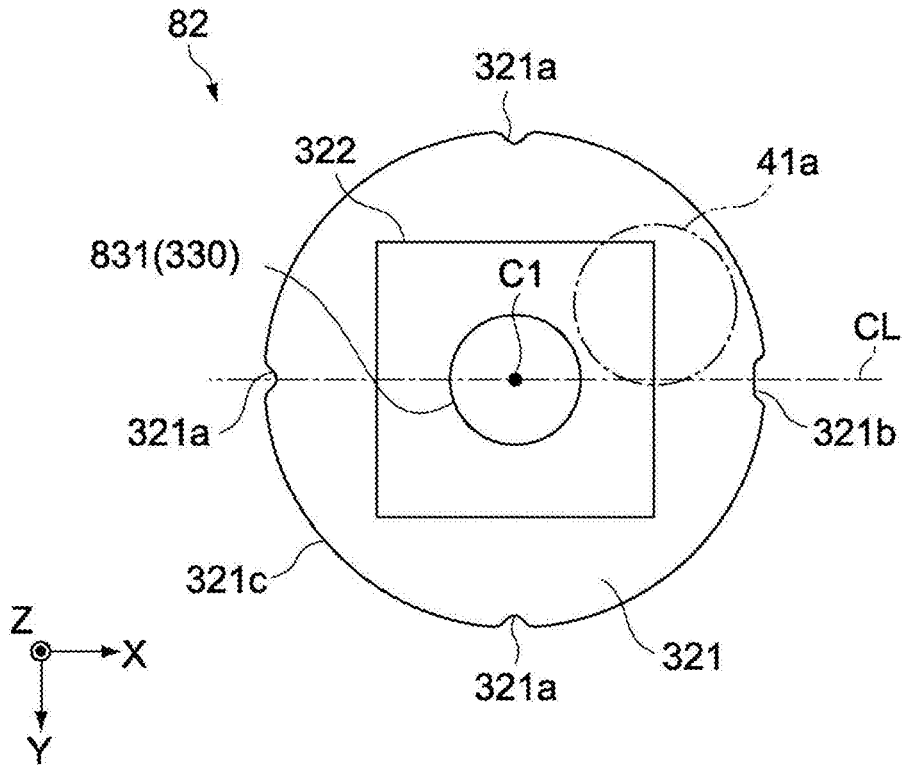
FIG. 14 is a schematic plan view of the piezoelectric speaker in the electroacoustic transducer pertaining to the third embodiment of the present invention.

FIG. 14 is a plan view of a piezoelectric speaker of an electroacoustic transducer pertaining to the third embodiment of the present invention. The following primarily explains those constitutions different from the corresponding constitutions in the first embodiment, and other constitutions identical to those in the first embodiment are denoted by the same symbols and not explained or explained succinctly.

A piezoelectric speaker 82 in this embodiment is different from the first embodiment in the constitution of an opening 831 constituting the passage 330. To be specific, the opening 831 is constituted by a single through hole that penetrates through the vibration plate 321 and the piezoelectric element 322 in their thickness direction (Z-axis direction). The opening 831 is provided at the center of the vibration plate 321 (the piezoelectric speaker 82). The opening shape of the opening 831 is not limited to circular, as illustrated, and the opening may be oval, rectangular, or formed in any other shape.

The electroacoustic transducer in this embodiment also has the sound introduction port 41*a* provided at a position where the sound introduction port 41*a* does not overlap the opening 831 of the piezoelectric speaker 32 in the Z-axis direction. The opening 831 is formed in an appropriate size so as not to overlap the sound introduction port 41*a* in the Z-axis direction. Accordingly, the same operational effects as the one with the first embodiment can be obtained.

According to this embodiment, acoustic characteristics not dependent on the position (rotated position) of the piezoelectric speaker 82 relative to the housing 40 can be obtained because the opening 831 is formed at the center of the vibration plate 321 in a size that does not allow the opening 831 to overlap the sound introduction port 41*a* in the Z-axis direction.

Figure 15:
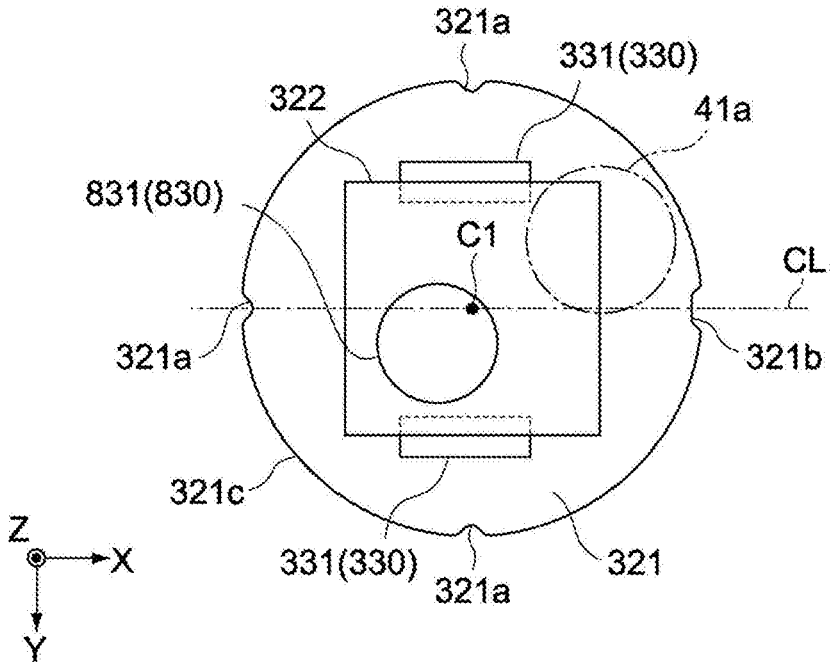
FIG. 15 is a schematic plan view showing a constitutional variation example of the aforementioned piezoelectric speaker.

It should be noted that the opening 831 need not be provided at the center of the vibration plate 321; instead, it may be provided at a position other than the center of the vibration plate 321, as shown in FIG. 15, for example. Also, openings other than the opening 831 may be provided in the piezoelectric element 322 in-plane, the openings 331 that also prevent short-circuiting of the external electrodes of the piezoelectric element 322 as shown in FIG. 15, or the openings 332 positioned between the periphery 321*c* of the vibration plate 321 and the piezoelectric element 322 (refer to FIG. 3), may further be provided in the vibration plate 321 (the same applies to FIG. 14).

Fourth Embodiment

Figure 16:
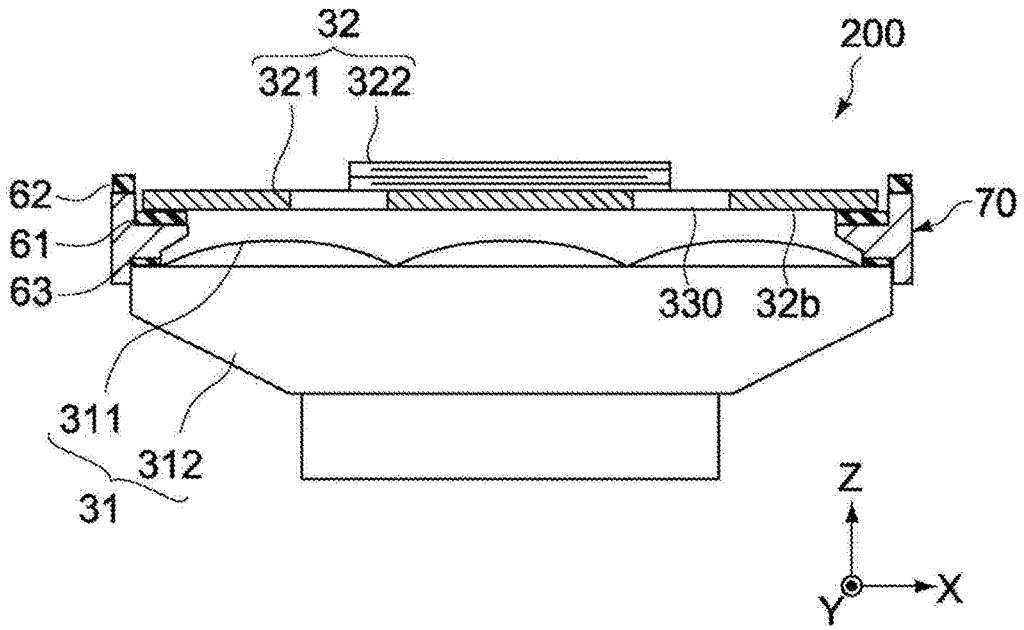
FIG. 16 is a cross-sectional side view showing, in a schematic manner, the constitution of the electroacoustic transducer pertaining to the second embodiment of the present invention.
Figure 17:
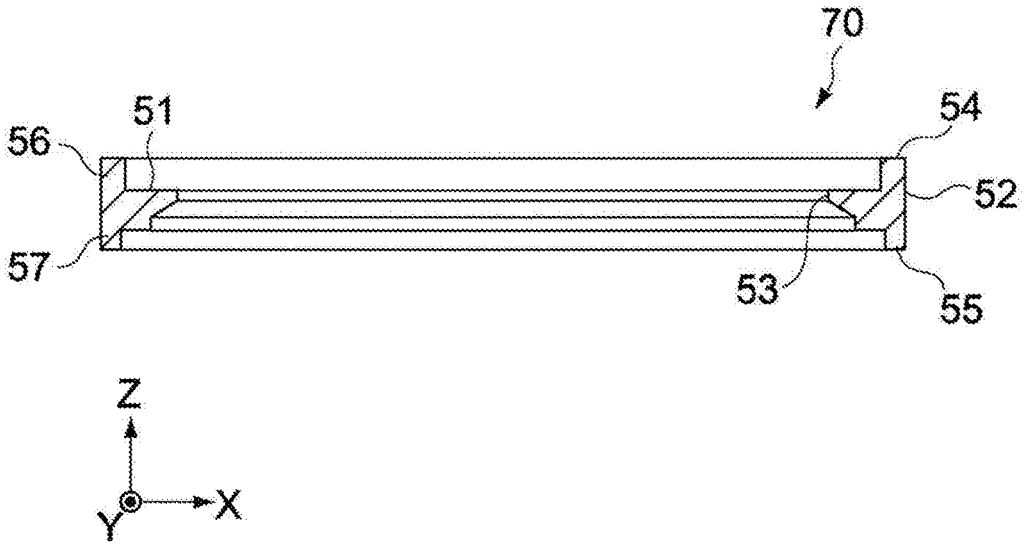
FIG. 17 is a schematic cross-sectional side view of the support member in the aforementioned electroacoustic transducer.

FIG. 16 is a cross-sectional side view showing, in a schematic manner, the constitution of an earphone 200 pertaining to the fourth embodiment of the present invention, while FIG. 17 is a schematic cross-sectional side view of a support member 70. It should be noted that, in FIG. 16, the housing 40 is not illustrated for an easier understanding.

The following primarily explains the constitutions different from the corresponding constitutions in the first embodiment, and other constitutions identical to those in the first embodiment are denoted by the same symbols and not explained or explained succinctly.

The earphone 200 in this embodiment is different from the first embodiment in the constitution of the support member 70 that supports the piezoelectric speaker 32. To be specific, the support member 70 is identical to the one in the first embodiment in that it has the support face 51, the outer periphery face 52, the inner periphery face 53, the tip face 54, the bottom face 55, and the first ring-shaped piece 56, but the support member 70 differs from the one in the first embodiment in that it further has a second ring-shaped piece 57 that projects downward toward the outer periphery of the bottom face 55.

In this embodiment, the support member 70 is constituted by a material whose Young's modulus is 3 GPa or more, just like the support member 50 in the first embodiment. Furthermore, in this embodiment the support member 70 further has the second ring-shaped piece 57 on the outer periphery of the bottom face 55, and therefore exhibits higher rigidity than the support member 50. Accordingly, the piezoelectric speaker 32 that vibrates in the high-frequency range can be supported in a more stable manner.

The second ring-shaped piece 57 may be constituted in such a way that it engages with the outer periphery of the dynamic speaker 31 (main body 312), as shown in FIG. 16. This way, the relative positioning accuracy and ease of assembly of the dynamic speaker 31 and the piezoelectric speaker 32 can be improved.

The foregoing explains the embodiments of the present invention; however, the present invention is not limited to the aforementioned embodiments, and needless to say, various changes may be added thereto.

For example, the above embodiments are explained using an example of an electroacoustic transducer having both of the dynamic speaker 31 and the piezoelectric speaker 32 or 72; however, the present invention can also be applied to an electroacoustic transducer constituted only by a piezoelectric speaker.

Also, the above embodiments are explained by citing an earphone as an example of an electroacoustic transducer; however, this is not the only example, and the present invention can also be applied to headphones, stationary speakers, speakers built into mobile information terminals, and so on.

Furthermore, in the above embodiments, the support member 50 is provided as a supporting part that supports the piezoelectric speaker 32; however, the support member 50 may also be constituted as part of the housing 40 or the dynamic speaker 31.

In the present disclosure where conditions and/or structures are not specified, a skilled artisan in the art can readily provide such conditions and/or structures, in view of the present disclosure, as a matter of routine experimentation. Also, in the present disclosure including the examples described above, any ranges applied in some embodiments may include or exclude the lower and/or upper endpoints, and any values of variables indicated may refer to precise values or approximate values and include equivalents, and may refer to average, median, representative, majority, etc. in some embodiments. Further, in this disclosure, "a" may refer to a species or a genus including multiple species, and "the invention" or "the present invention" may refer to at least one of the embodiments or aspects explicitly, necessarily, or inherently disclosed herein. The terms "constituted by" and "having" refer independently to "typically or broadly comprising", "comprising", "consisting essentially of", or "consisting of" in some embodiments. In this disclosure, any defined meanings do not necessarily exclude ordinary and customary meanings in some embodiments.

The present application claims priority to Japanese Patent Application No. 2017-034514, filed Feb. 27, 2017, and No. 2017-066713, filed Mar. 30, 2017, the disclosure of which is incorporated herein by reference in its entirety including any and all particular combinations of the features disclosed therein.

It will be understood by those of skill in the art that numerous and various modifications can be made without departing from the spirit of the present invention. Therefore, it should be clearly understood that the forms of the present invention are illustrative only and are not intended to limit the scope of the present invention.

We claim:

1. An electroacoustic transducer comprising:

a piezoelectric speaker having:

a first vibration plate with a periphery; and a piezoelectric element placed on at least one face of the first vibration plate, wherein a planar shape of the piezoelectric element is rectangular, and multiple openings are provided around the piezoelectric element and penetrate through the first vibration plate as viewed in a thickness direction of the first vibration plate that is a first axis direction; and a housing having:

a supporting part that supports the periphery of the first vibration plate;

a support member fixed to the supporting part and having a support face for supporting the periphery of the first vibration plate, wherein the support member is constituted by a material whose Young's modulus is 3 GPa or more; and a sound introduction port facing the piezoelectric speaker in the first axis direction, and provided at a position where the sound introduction port does not substantially overlap, as viewed in the first axis direction, a first opening which is the largest among the multiple openings and which is larger than another of the multiple openings in terms of an open area as viewed in the first axis direction, wherein the first opening has a contour defining a periphery of the first opening as viewed in the first axis direction, a part of which contour is formed by a part of the piezoelectric element as viewed in the first axis direction.

2. The electroacoustic transducer according to claim 1, wherein the first opening is partially covered by the periphery of the piezoelectric element.

3. The electroacoustic transducer according to claim 2, wherein there are two first openings which are constituted by a pair of openings that are disposed away from each other in a second axis direction that is perpendicular to the first axis direction.

4. The electroacoustic transducer according to claim 3, wherein the multiple openings include a second opening that overlaps the sound introduction port as viewed in the first axis direction.

5. The electroacoustic transducer according to claim 2, wherein the multiple openings include a second opening that is disposed away from the first opening in a second axis direction perpendicular to the first axis direction.

6. The electroacoustic transducer according to claim 1, wherein the support member is constituted by a ring-shaped block made of a metal material.

7. The electroacoustic transducer according to claim 1, wherein the support member is constituted by a ring-shaped block made of a synthetic resin material or composite material primarily constituted by synthetic resin material.

8. The electroacoustic transducer according to claim 1, further comprising a first adhesive layer placed between the support face and the periphery of the first vibration plate, to elastically support the periphery against the support face.

9. The electroacoustic transducer according to claim 8, wherein the housing has a first housing part that supports the support member, and a second housing part that covers the piezoelectric speaker and is joined to the first housing part, while the support member further has a first ring-shaped piece that surrounds the periphery; and the electroacoustic transducer further comprises a second adhesive layer placed between the first ring-shaped piece and the second housing part, and the second adhesive layer elastically supports the first ring-shaped piece against the second housing part.

10. The electroacoustic transducer according to claim 1, further comprising a dynamic speaker that includes a second vibration plate, wherein the housing has a first space in which the dynamic speaker is placed, and a second space that interconnects the first space and the sound introduction port through the multiple openings.

11. The electroacoustic transducer according to claim 10, wherein the dynamic speaker further has a main body that supports the second vibration plate in a vibratory manner, and the support member further has a second ring-shaped piece provided on a face opposite the support face and engaged with an outer periphery of the main body.

12. An electroacoustic transducer comprising:

a piezoelectric speaker having:

a first vibration plate with a periphery; and a piezoelectric element placed on at least one face of the first vibration plate, wherein a planar shape of the piezoelectric element is rectangular, and an opening is provided in a manner penetrating through the first vibration plate and the piezoelectric element as viewed in a thickness direction of the first vibration plate that is a first axis direction; and a housing having:

a supporting part that supports the periphery;

a support member fixed to the supporting part and having a support face for supporting the periphery of the first vibration plate, wherein the support member is constituted by a material whose Young's modulus is 3 GPa or more; and a sound introduction port facing the piezoelectric speaker in the first axis direction, and provided at a position where the sound introducing port does not substantially overlap the opening in the first axis direction, wherein additional openings are provided around the piezoelectric element and penetrate through the first vibration plate as viewed in the first axis direction, wherein the openings are partially covered by a periphery of the piezoelectric element.

13. An electroacoustic transducer comprising:

a piezoelectric speaker having:

a first vibration plate with a periphery; and a piezoelectric element placed on at least one face of the first vibration plate, wherein multiple openings are provided around the piezoelectric element and penetrate through the first vibration plate as viewed in a thickness direction of the first vibration plate that is a first axis direction; and a housing having:

a supporting part that supports the periphery of the first vibration plate;

a support member fixed to the supporting part and having a support face for supporting the periphery of the first vibration plate, wherein the support member is constituted by a material whose Young's modulus is 3 GPa or more; and a sound introduction port facing the piezoelectric speaker in the first axis direction, and provided at a position where the sound introduction port does not substantially overlap, as viewed in the first axis direction, a first opening having the largest open area among the multiple openings, wherein the support member further has a first ring-shaped piece which projects upward in the first axis direction along an outer periphery of the support face in a manner surrounding the periphery of the first vibration plate as viewed in the first axis direction and a direction perpendicular to the first axis direction.

* * * * *